US005332150A

United States Patent [19]

Poirier

[11] Patent Number: 5,332,150

[45] Date of Patent: Jul. 26, 1994

[54] EASY-OPEN SHIPPING/DISPLAY CONTAINER, AND A BLANK FOR ERECTING THE SAME

[75] Inventor: Norman W. Poirier, Dorion Quebec, Canada

[73] Assignee: Kraft General Foods Canada Inc., Don Mills, Canada

[21] Appl. No.: 60,281

[22] Filed: May 11, 1993

[51] Int. Cl.[5] ..... B65D 5/54

[52] U.S. Cl. ..... 229/235; 53/381.1; 225/96.5; 229/204; 229/237; 229/240; 414/412

[58] Field of Search ..... 229/204, 235, 237, 243, 229/240, 242; 206/44 R; 493/56, 57, 63, 340; 53/381.1, 381.2; 225/96.5; 414/411, 412

[56] References Cited

U.S. PATENT DOCUMENTS

| | | | |
|---|---|---|---|
| 2,085,649 | 6/1937 | Gluck | 229/242 |
| 2,098,818 | 11/1937 | Andrews | 229/242 |
| 2,146,420 | 2/1939 | Davidson | 229/243 |
| 2,729,885 | 1/1956 | Wahl et al. | 53/381.2 |
| 2,822,118 | 2/1958 | Will | 229/243 |
| 3,002,613 | 10/1961 | Merkel et al. | 229/240 |
| 3,056,655 | 10/1962 | Linda et al. | 229/237 |
| 3,160,274 | 12/1964 | Pritchard | 229/240 |
| 3,220,319 | 11/1965 | Kelley | 225/96.5 |
| 3,606,058 | 9/1971 | Davis | 414/412 |
| 3,642,273 | 2/1972 | Baglio | 229/235 |
| 3,823,866 | 7/1974 | Elward et al. | 229/235 |
| 4,109,841 | 8/1978 | DeTorre | 225/96.5 |
| 4,350,281 | 9/1982 | Dornbursh et al. | 229/38 |
| 4,421,229 | 12/1983 | Pan et al. | 206/44 R |
| 4,437,570 | 3/1984 | Sorenson | 206/601 |
| 4,784,271 | 11/1988 | Wosaba, II et al. | 206/617 |
| 4,825,549 | 5/1989 | Huang | 493/57 |

FOREIGN PATENT DOCUMENTS

| | | | |
|---|---|---|---|
| 613063 | 1/1961 | Canada | 229/235 |
| 241026 | 10/1987 | European Pat. Off. | 229/235 |
| 1366446 | 1/1988 | U.S.S.R. | 414/412 |
| 1604671 | 11/1990 | U.S.S.R. | 414/412 |

*Primary Examiner*—Gary E. Elkins
*Attorney, Agent, or Firm*—Linn I. Grim

[57] ABSTRACT

A shipping/display container that may be opened without having to use a knife or other sharp instrument, and a blank for forming such a container. The container blank includes a plurality of side panels foldably connected together in a longitudinal series, and a connecting flap foldably connected to a first end of the side panels. The side panels form a line of weakness extending substantially completely across each of the side panels, and the connecting flap forms a notch extending from the first end of the side panels. To form the container, the connecting flap is connected to the second end of the side panels, forming the side panels into a continuous side wall for the container; and as this is done, the notch in the connecting flap is positioned over the end portion of the line of weakness. To open the container, the container is severed along the line of weakness to separate the container into a top section and a bottom tray section, and the top section of the container is removed to expose the interior of the container.

13 Claims, 3 Drawing Sheets

EASY-OPEN SHIPPING/DISPLAY CONTAINER, AND A BLANK FOR ERECTING THE SAME

BACKGROUND OF THE INVENTION

The present invention relates to shipping containers, and more particularly, to shipping containers that are intended to be converted into a display at the filling and palletizing stage or after opening at the final destination point. Even more specifically, this invention relates to such shipping/display containers that can be readily opened without having to use a knife or other sharp instrument.

In the consumer products industry, individual products are typically placed in larger containers or cartons that are shipped to retail establishments such as supermarkets. Often, at the retail establishment, the shipping container is cut open, along the perimeter of the container. Then, the top section of the container is removed and discarded, and the bottom section of the container is used as a display tray. There are numerous, well-known advantages to the use of such shipping/display containers. For instance, a large number of individual product packages may be placed on a shelf in the retail establishment by simply placing one of the shipping/display containers on that shelf. Also, the open display trays may be stacked on top of each other, on shelves, on separate display stands, or in the aisles between the shelves.

Commonly, knives or other sharp cutting tools are used to cut open containers of the above-described type. In opening the containers in this manner, it is very easy to cut accidently too deeply through the container walls and into the individual packages inside the container. Cutting into those individual packages almost always causes a loss of a certain amount of the product in those packages and creates a mess that may be expensive to clean. Further, if those inside packages contain a liquid, such as a beverage, cutting into the packages may result in a total loss of the product in the packages.

Various solutions have been proposed to prevent the accidental cutting of the packages inside the display/-shipping containers. For instance, U.S. Pat. No. 4,784,271 discloses a shipping/display container that is precut along a line of severance into separate top and bottom sections. These container sections are then taped together by adhesively attaching a wide tape to the side walls of the container, over the cut line between the two container sections. This wide tape has a narrow tear filament or strip attached to its inner surface; and the container is opened by pulling that tear strip to split the tape bridging the container sections, thereby separating the container into a top cover section and a bottom tray section.

U.S. Pat. No. 4,437,570 discloses a shipping carton having several bowed side walls that hold the inner packages away from outside edges of the carton. A knife can be inserted through those outside edges of the carton to open the carton without cutting the packages held therein. U.S. Pat. No. 4,350,281 discloses a container having one or more of its side walls formed from plural layers of panels or flaps. The outer layer of such a side wall is cut to open the container, while the inner layer of the side wall protects the packages inside the container.

The containers shown in the above-identified references are not very economical for general use; and none of the containers provides a complete, economically practical solution to the problem of fully protecting the contents of a shipping/display container from damage when the container is cut or sliced open.

SUMMARY OF THE INVENTION

The present invention relates to a shipping/display display container that may be opened without having to use a knife or other sharp instrument, and a blank for forming such a container. The container blank includes a plurality of side panels foldably connected together in a longitudinal series, top and bottom flaps, and a connecting flap foldably connected to a first end edge of the side panels. The side panels form a line of weakness extending substantially completely across each of the side panels, between longitudinally aligned first and second end points, and the connecting flap forms a notch extending from the first end edge of the side panels and longitudinally aligned with the two end points of the line of weakness.

To form the container, the connecting flap is connected to the side panel at the second end of the side panels to form a continuous side wall for the container. As this is done, the notch is positioned over the end portion of the line of weakness in that end panel. Then, top and bottom walls for the container are formed from the top and bottom flaps of the container blank, enclosing the interior of the container. To open the container, the container is severed along the line of weakness to separate the container into a top section and a bottom tray section, and this may be done by forcing a blunt instrument along the line of weakness. Then, the top section of the container is removed to expose the interior of the container.

The notch in the connecting flap allows for easy splitting of the container. The use of a blunt instrument to open the container helps to insure that packages inside the container are not accidentally cut open.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
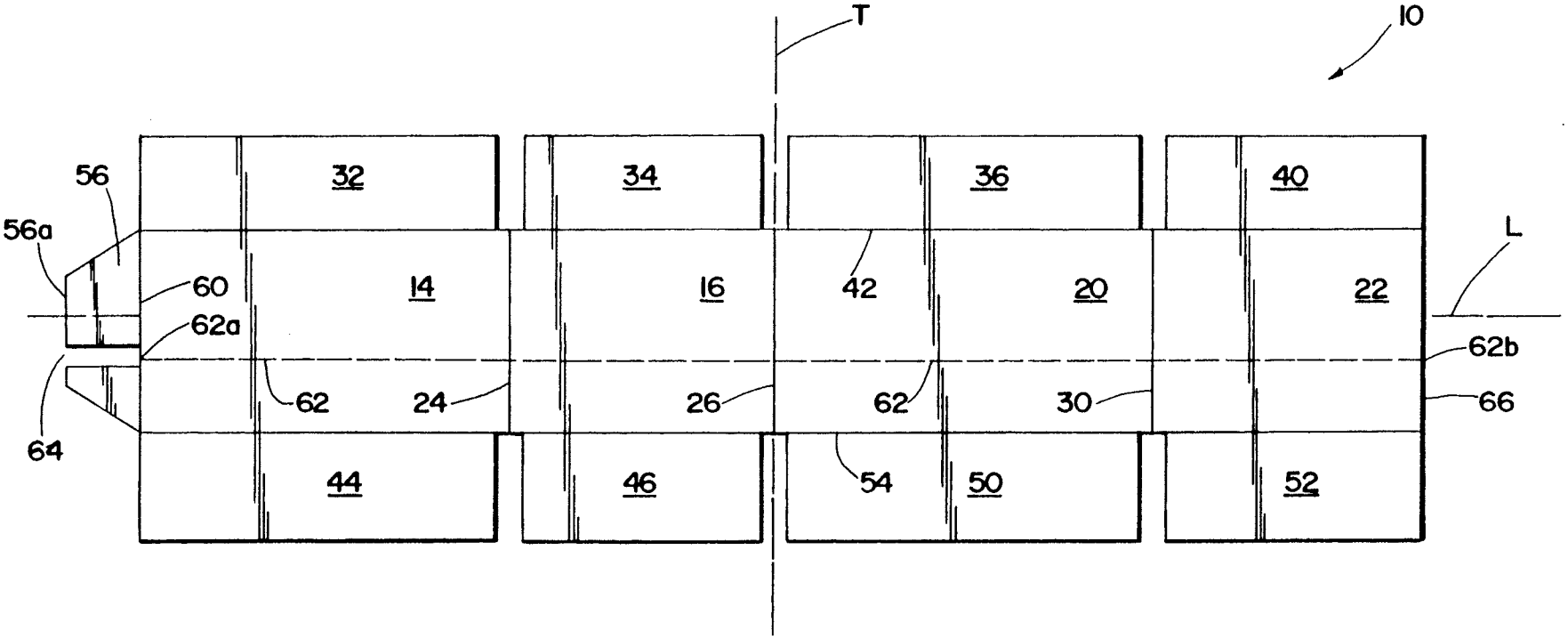
FIG. 1 is a plan view of a container blank embodying teachings of the present invention.
Figure 2:
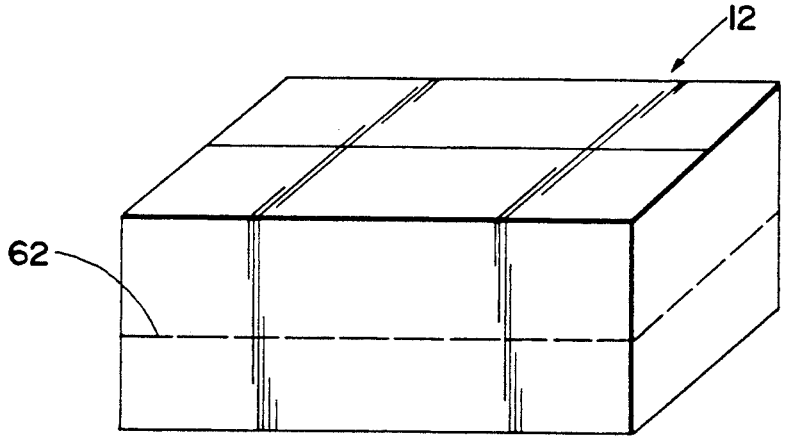
FIG. 2 is an orthogonal view of a container formed from the blank illustrated in FIG. 1.

FIG. 1 shows blank 10, and FIG. 2 shows carton 12 made from the blank of FIG. 1. Blank 10, generally comprises consecutive side panels 14, 16, 20, and 22 hingedly connected together in series at crease lines 24, 26, and 30. Top closure flaps 32, 34, 36, and 40 are hingedly connected to side panels 14, 16, 20, and 22, respectively, along a common crease line 42 that extends along the top edge of the side panels. Similarly, bottom closure flaps 44, 46, 50, and 52 are hingedly connected to side panels 14, 16, 20, and 22, respectively, along a common crease line 54 that extends along the bottom edge of the side panels. A manufacturers joint or flap 56 is connected to side panel 14 by fold line 60. With all the flaps and panels of blank 10 connected together as shown in FIG. 1, the blank is generally rectangular and has a longitudinal axis L and a transverse axis T.

To facilitate opening the container 12 formed from the blank 10, a line of weakness 62 is formed in the side panels of the blank, and an aligned notch or recess 64 is formed in manufacturers joint 56. With the embodiment of blank 10 shown in FIG. 1, line of weakness 62 extends across each of the side panels, between longitudinally aligned end points 62*a* and 62*b*. Preferably, line 62 is a straight line between those end points, although the line of weakness may be curved or wavy or have some other irregular shape.

Notch 64 extends outward from end point 62*a* of the line of weakness 62, and the notch is longitudinally aligned with both end points 62*a* and 62*b* of line 62. Notch 64 allows container 12 to be split along line 62, into upper and lower sections, without requiring that any cut or tear be made through a double layer of panels or panel portions. Preferably, notch 64 extends completely through manufacturers joint 56, from fold line 60 to the distal edge 56*a* of joint 56. Also, with the embodiment of blank 10 shown in FIG. 1, notch 64 is spaced from the side edges of manufacturers joint 56; and notch 64 has a U-shape, including a pair of parallel side edges, and a base edge that is formed by a portion of fold line 60.

Line of weakness 62 may be made in any suitable manner. Preferably, however, this line is formed by a multitude of small, closely spaced slits or perforations, each of which extends completely through blank 10. For instance, line 62 may be made of through slits formed at a density or rate of eight slits per inch, with each slit being about 3/32 of an inch long, and the slits being spaced apart 1/32 of an inch. On the one hand, such a line of weakness can be severed or torn without undue difficulty, as described below. On the other hand, this line of weakness does not appreciably affect the strength of container 12 and thus does not hinder the ability of that container to hold and to transport a normal load in normal use.

Preferably, blank 10 is made in a high speed manufacturing process, in which a suitable die is used to cut and score the blank from a continuous web of relatively stiff and rigid material such as thick paper, paper board, kraft paper, or cardboard. Line of weakness 62 and notch 64 may be formed in blank 10 before or after the blank is severed from the web. In applications where high compression strength is required, blank 10 may be made of corrugated paper board in which the corrugations or flutes run perpendicular to the longitudinal axis L of the blank. In the case of a corrugated box the line of weakness 62 is formed in blank 10 on the corrugator before the blank is severed from the web and notch 64 is formed in blank 10 on the printer slotter gluing machine. In the case of a die cut corrugated box the line of weakness 62 and notch 64 is formed in blank 10 on a flat bed die cutting machine after the sheet is severed from the web.

Container 12, shown in FIG. 2, is formed from blank 10 by a relatively straightforward series of folds. More specifically, panels 14 and 16 are folded 90° about fold line 26, and panel 22 is folded 90° about fold line 30. Then panel 14 is folded 90° about fold line 24, bringing edges 60 and 66 together. Manufacturers joint or flap 56 is then folded 90° about fold line 60 and secured to either the inside or outside surface of side panel 22, thus connecting the four side panels together to form a continuous side wall around the interior of container 12. Bottom flaps 44, 46, 50, and 52 are then folded 90° about bottom edge 54 to form the bottom panel of the container. The container is then filled with smaller packages, and then top flaps 32, 34, 36, 40 are folded 90° about top edge 42 to close the top of the container. Container 12 may be formed from blank 10 by hand or by standard container making equipment.

Figure 3:
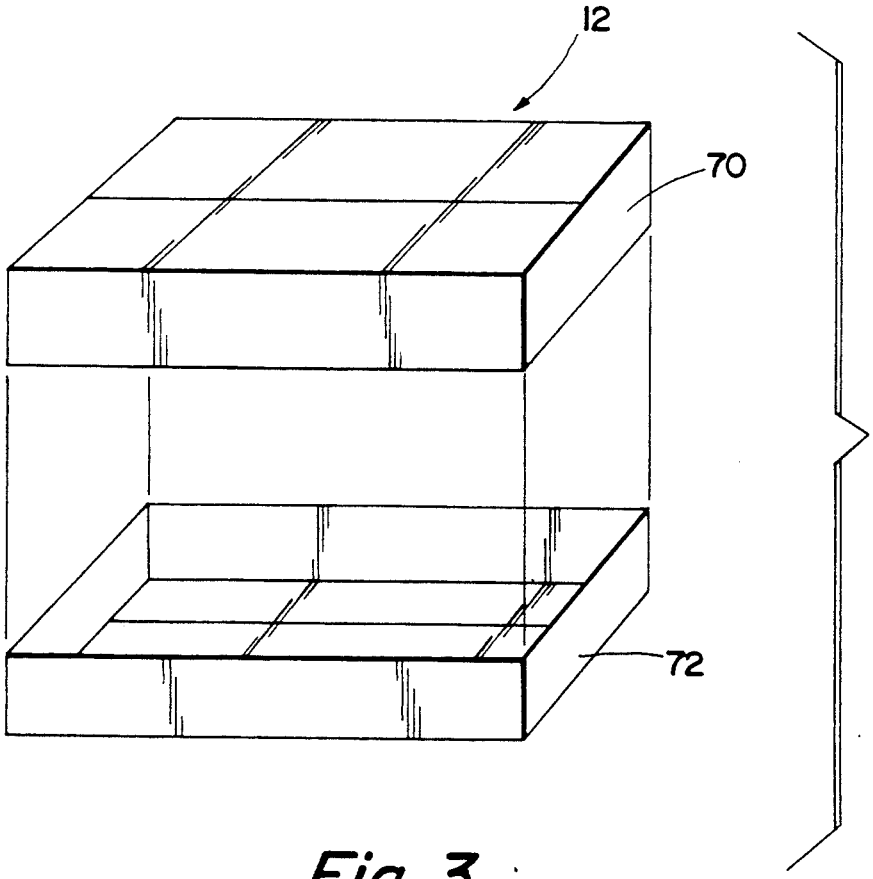
FIG. 3 is an orthogonal view of the container, with the upper and lower sections of the container separated.

With reference to FIGS. 2 and 3, container 12 is opened by severing the container along line of weakness 62, separating the container into upper and lower sections 70 and 72. The upper section of the container is then discarded, and the remaining, lower section of the container can be used for display purposes, or that lower container section can be stacked with the lower sections of other similar containers.

With line of weakness 62, it is not necessary to use a knife or similar sharp object to cut the container along line 62, and instead a tool not having a sharp edge can be used to open the container. For example, a thin wheel having a relatively flat circumferential surface can be rolled over line 62, around the container, to sever the container along that line of weakness, and this can be done by hand or in an automated or semi-automated process.

Figure 4:
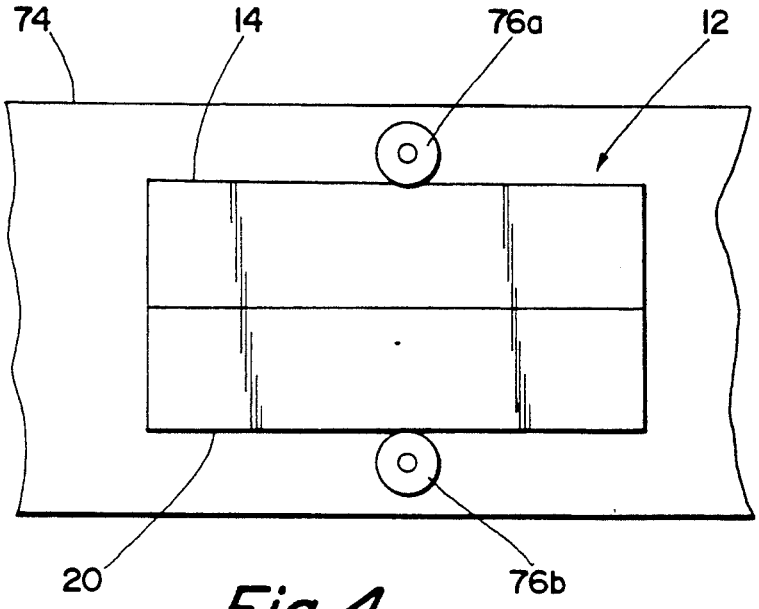
FIGS. 4 and 5 are plan views of the container, showing the container being opened.
Figure 5:
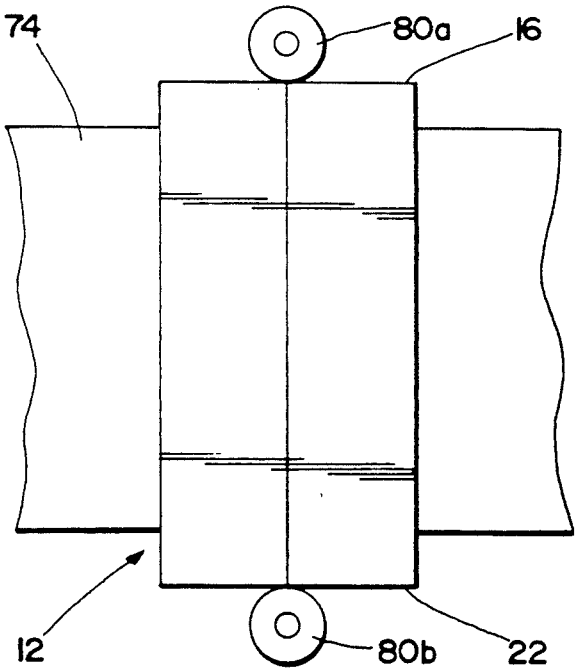

With reference to FIGS. 4 and 5, container 12 may be opened by placing the container on a conveyor 74 that carries the container past first and second pairs of wheels 76*a*, 76*b* and 80*a* and 80*b*. Wheels 76*a*, 76*b* are positioned and supported in any suitable manner such that the wheels push the side walls 14 and 20 of the container inward along the line of weakness 62, breaking the container apart along that line. After the container has been transported past wheels 76*a*, 76*b*, the container is turned 90° on conveyor 74, which then carries the container past wheels 80*a* and 80*b*. Wheels 80*a* and 80*b* are positioned so that they engage and push side walls 16 and 22 inward along the line of weakness, completing the severing of the container along that line.

Figure 6:
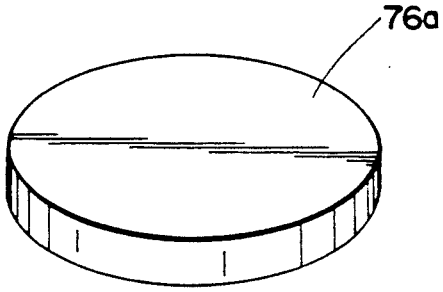
FIG. 6 is a perspective view of one of the pressure wheels shown in FIGS. 4 and 5.

FIG. 6 is a perspective view of one of the wheels 76*a*; and as shown therein, preferably the wheel has a flat outside circumferential surface. In this way, even if the wheel comes into contact with any packages inside container 12, the wheel will not cut into those interior packages. As mentioned above, wheels 76*a*, 76*b*, 80*a*, and 80*b* may be positioned and supported in any suitable manner. Further, as will be understood by those of ordinary skill in the art, other instruments may also be used to sever container 12 along line of weakness 62.

While it is apparent that the invention herein disclosed is well calculated to fulfill the objects previously stated, it will be appreciated that numerous modifications and embodiment may be devised by those skilled in the art, and it is intended that the appended claims cover all such modifications and embodiments as fall within the true spirit and scope of the present invention.

I claim:

1. A blank for erecting an easy-open shipping/display container, comprising:

a plurality of side panels foldably connected together in a longitudinal series, said plurality of panels forming an upper edge, a lower edge, and longitudinally opposed first and second end edges, at least one bottom flap connected to said lower edge;

at least one top flap connected to said upper edge; and a connecting flap foldably connected to one of the side panels, along the first end edge, and extending outward therefrom, the plurality of side panels forming a line of weakness extending substantially completely across each of said side panels between longitudinally aligned first and second end points, said line of weakness being formed by a multitude of closely spaced through slits formed in the side panels of the blank and positioned along the line of weakness at a rate of approximately eight slits per inch;

the connecting flap forming a notch extending from said first end edge, and longitudinally aligned with said first and second end points.

2. A blank according to claim 1, wherein the line of weakness is a straight line between said first and second end points.

3. A blank according to claim 1, wherein:

the connecting flap includes a distal transverse edge longitudinally spaced from said first side edge; and the notch of the connecting flap extends inward from the distal edge of the connecting flap to said first end edge.

4. A blank according to claim 3, wherein the notch has a U-shape, and includes first and second parallel side edges, and a base edge formed by a portion of the first end edge of the side panels.

5. An easy-open shipping/display container, comprising:

a plurality of side panels connected together in a longitudinal series, said plurality of panels forming an upper edge, a lower edge, and longitudinally opposite first and second end edges;

a connecting flap connected to said first end edge and to one of the side panels adjacent said second end edge, wherein the connecting flap connects the side panels together to form a continuous side wall for the container;

a bottom panel connected to the lower edge of said plurality of side panels; and a top panel connected to the upper edge of said plurality of side panels;

the plurality of side panels forming a line of weakness extending substantially completely across each of said side panels, between longitudinally aligned first and second end points, to facilitate serving the container into upper and lower sections;

the connecting flap forming a notch extending from said first end edge and longitudinally aligned with both of said first and second end points, to further facilitate serving the container along the line of weakness;

wherein the connecting flap includes a distal transverse edge longitudinally spaced from said first end edge, the notch of the connecting flap extends inward from said distal edge to said first end edge, and the notch has a U-shape including first and second parallel side edges and a base edge formed by a portion of the first end edge of the side panels.

6. A container according to claim 5, wherein the line of weakness is a straight line between said first and second end points.

7. A container according to claim 5, wherein the line of weakness is formed by a multitude of closely spaced through slits formed in the side panels.

8. A container according to claim 7, wherein the through slits are positioned along the line of weakness at a rate of approximately eight slits per inch.

9. A method of forming and opening an easy-open shipping/display container, comprising:

providing a container blank having i) a plurality of side panels foldably connected together in a longitudinal series, ii) top and bottom panels, and iii) a connecting flap foldably connected to a first end edge of the side panels;

forming a line of weakness in the side panels, the line of weakness extending substantially completely across each of said side panels, between longitudinally aligned first and second end points;

forming a notch in the connecting flap, the notch extending from said first end edge, and being longitudinally aligned with said first and second end points;

connecting the connecting flap to one of said side panels, adjacent a second end of the side panels, to form a continuous side wall for the container, and connecting step including a step of positioning the notch over an end portion of the line of weakness in said one of said side panels;

forming top and bottom walls for the container from the top and bottom panels to enclose an interior of the container;

severing the container along said line of weakness by moving a flat edge of an opening instrument along the line of weakness to separate the container into a top section and a bottom tray section; and removing the top section of the container to expose the interior thereof.

10. A method according to claim 9, wherein the severing step includes a step of rolling a rotatable wheel along said line of weakness to sever the container therealong.

11. A method according to claim 10, wherein the wheel has a flat circumferential edge, and the rolling step includes a step of rolling said flat edge along the line of weakness to sever the container.

12. A method according to claim 7, wherein the step of forming the line of weakness includes a step of forming a multitude of closely spaced slits through the side panels of the container blank.

13. A method according to claim 12, wherein the step of forming the slits includes a step of forming the slits along the line of weakness at a rate of approximately eight slits per inch.

* * * * *